United States Patent [19]

Robbins et al.

[11] Patent Number: 5,024,626

[45] Date of Patent: Jun. 18, 1991

[54] SOUND PRODUCING REMOTE CONTROL TOY VEHICLE

[76] Inventors: Jack Robbins, 197 Summit Ave., Pompton Lakes, N.J. 07442; Dietmar Nagel, 147 South Rd., Chester, N.J. 07930

[21] Appl. No.: 649,407

[22] Filed: Feb. 1, 1991

[51] Int. Cl.[5] ..... A63H 5/00; A63H 17/34

[52] U.S. Cl. ..... 446/409; 446/454

[58] Field of Search ..... 446/397, 409, 410, 454–456, 446/411; 273/86 B

[56] References Cited

U.S. PATENT DOCUMENTS 3,664,060 5/1972 Longnecker ..... 446/410
4,291,877 9/1981 Ensmann et al. ..... 446/409 X
4,325,199 4/1982 McEdwards ..... 446/409
4,817,948 4/1989 Simonelli ..... 273/86 B

*Primary Examiner*—Mickey Yu
*Attorney, Agent, or Firm*—Blum Kaplan

[57] ABSTRACT

A remote control toy vehicle system includes a toy vehicle and a remote control. The toy vehicle includes a motor for selectively driving the toy vehicle. The remote control is electrically coupled to the toy vehicle and includes a manually actuatable first control switch for controlling the motor. The remote control also includes a sound producing circuit for selectively producing sounds related to the toy vehicle. Manually actuatable second control switches on the remote control the sounds producible by the sound producing circuitry.

20 Claims, 5 Drawing Sheets

FIG. 2
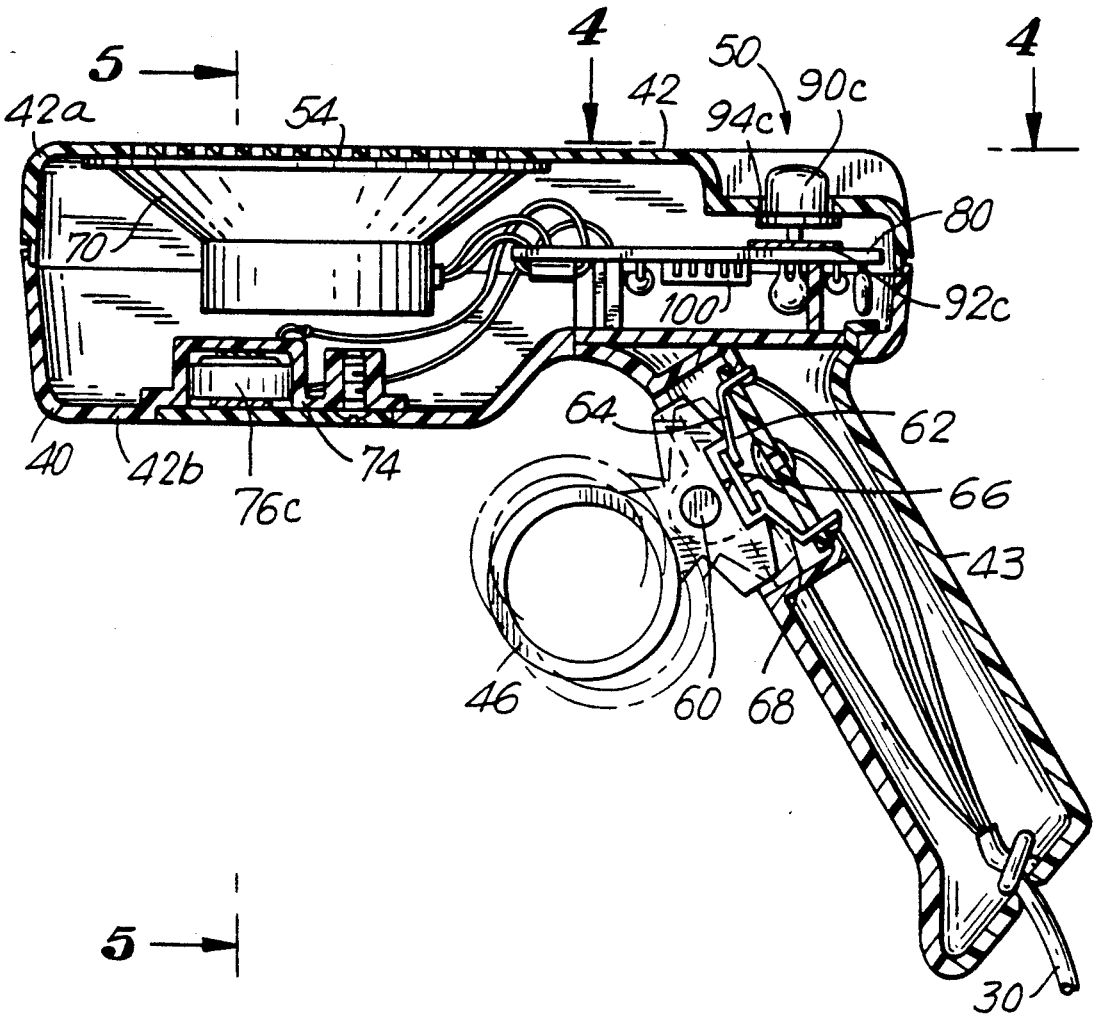
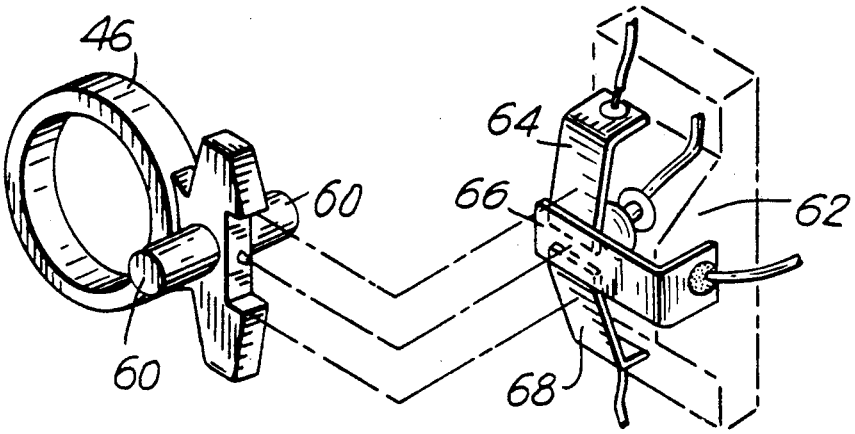
FIG. 3

SOUND PRODUCING REMOTE CONTROL TOY VEHICLE

BACKGROUND OF THE INVENTION

The present invention is directed generally to a sound producing remote control toy vehicle and, in particular, to a motor-driven toy vehicle which is controlled by a remote control which includes a sound producing circuit and speaker system which selectively produces vehicle-related or other created sounds such as action sounds.

Toy vehicles have always been a popular and well-liked toy for children. Each year, toy vehicle manufacturers strive to provide new features and enhancements to toy vehicles which will enhance the play value and desirability thereof, thereby increasing the fun that children will experience with the toy.

From time to time, remote-controlled toy vehicles have been popular. Such toys include motor-driven toy vehicles and a separate remote hand controller which controls the action of the motor in the toy vehicle either through a wire or through radio control signals. Such remote-control systems include such simple remote controls as those that only cause the vehicle to go forward in a straight direction, those that permit control of the motor in forward and reverse directions, and those which permit both movement of the vehicle and steering thereof.

Recently, toy vehicle manufacturers have been incorporating sound producing devices, such as horns or sirens, directly in the toy vehicles which are actuated by pressing buttons or other controls on the toy vehicle itself or by pressing a selected portion of the toy vehicle body. However, when a toy vehicle which produces sound from the toy vehicle is remotely controlled, a child must physically manipulate the toy vehicle or portions thereof to produce sounds, thereby decreasing play value and the concomitant fun involved in playing with such toys.

Accordingly, it is desired to provide a remotely controlled toy vehicle in which a sound producing system is provided directly in the remote control itself to permit a user of the remote control of the toy vehicle to generate vehicle-related sounds from the remote control.

SUMMARY OF THE INVENTION

Generally speaking, in accordance with the present invention, a remote control toy vehicle is provided. The remote control toy vehicle includes a toy vehicle having a motor for selectively driving the toy vehicle and a remote control coupled to the toy vehicle but remote therefrom having a manually actuatable first control switch for controlling the motor. The remote control also includes a sound producing system for selectively producing sounds related to the toy vehicle or other created sounds or action sounds. A manually actuatable second control system supported on the remote control controls the sounds produced by the sound producing system.

In a preferred embodiment, the remote control is hand-held and includes first switch operable by a first finger of a user which controls action of the vehicle and at least on other switch actuatable by another finger of the user which controls the sound producing system. The sound producing system preferably includes a sound producing chip containing pre-recorded digitized sounds coupled to a speaker mounted in the remote control housing.

Accordingly, it is desired to provide a sound producing remote control toy vehicle in which sound is produced in the remote control.

Another object of the present invention is to provide a remote control for a toy vehicle which houses a sound producing circuit which produces sounds related to vehicles.

A further object of the present invention is to provide a sound producing remote control toy vehicle with enhanced play value.

A still further object of the present invention is to provide a hand-held remote control for a toy vehicle having a plurality of finger actuatable buttons which control a sound producing system supported on the hand-held remote control.

Yet another object of the present invention is to provide a sound producing remote control toy vehicle in which the remote control supports a sound producing system including a sound producing chip with pre-recorded vehicle-related digitized sounds and switches for controlling the sounds produced.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawing(s), in which:

FIG. 2 is an enlarged sectional view taken along line 2—2 of FIG. 1;

FIG. 3 is a exploded view of the trigger and motor switch system depicted in FIG. 2;

DETAILED DESCRIPTION OF THE PREFERRED EMBODIMENTS

Figure 1:
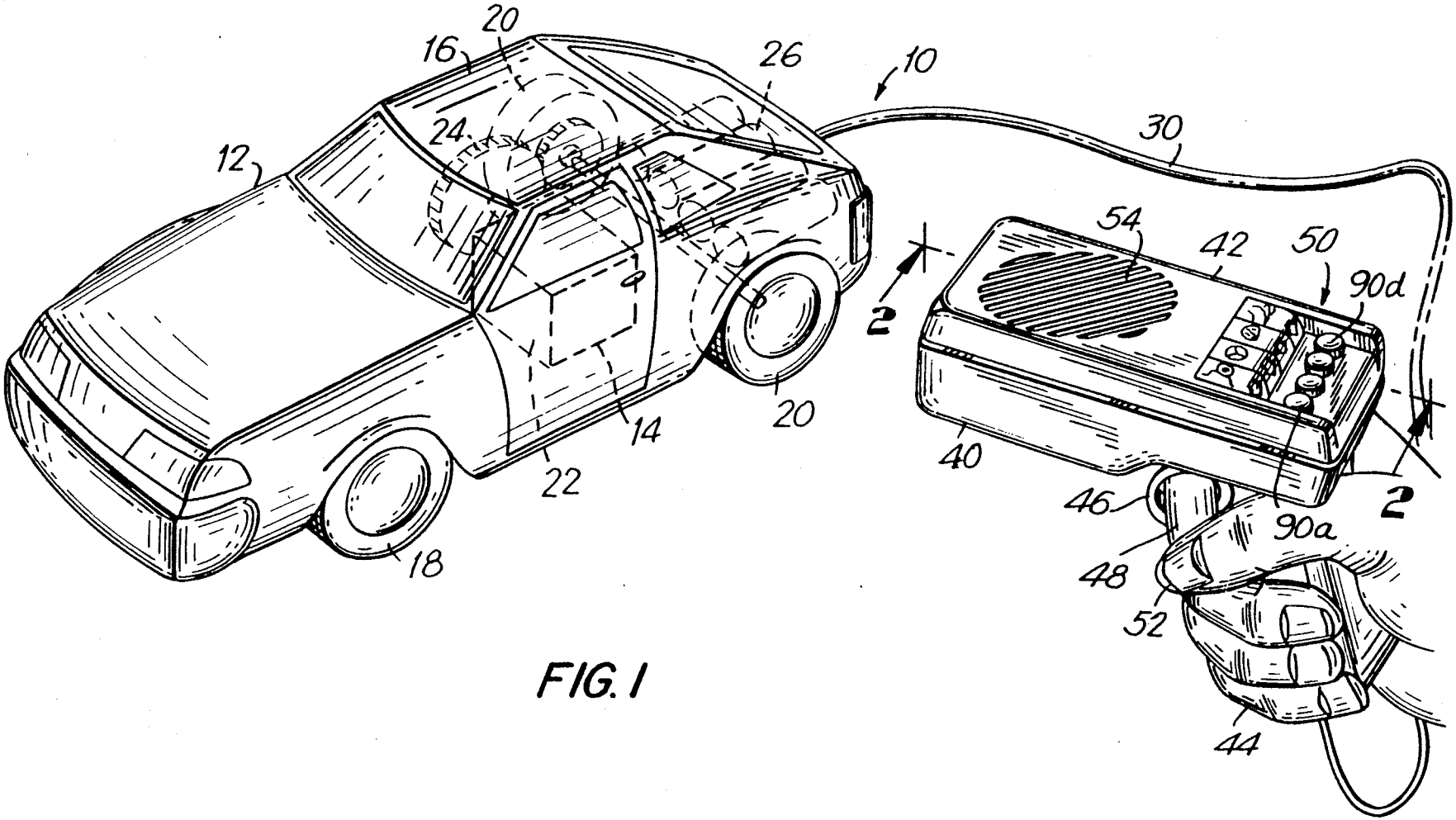
FIG. 1 is a perspective view of a sound producing remote control toy vehicle showing a toy vehicle and remote control in the hand of a user.

Reference is first made to FIG. 1 which depicts a sound producing remote control toy vehicle system, generally indicated at 10, and constructed in accordance with a preferred embodiment of the present invention. Toy vehicle system 10 includes a toy vehicle 12 and a remote control 40 coupled to toy vehicle 12 through a wire 30. Toy vehicle 12 includes a chassis 14 and a body 16. Toy vehicle 12 also includes a pair of front tires 18 and a pair of rear tires 20.

Toy Vehicle 12 also includes a motor 22 adapted to selectively drive toy vehicle 12 in forward and reverse directions, which is coupled through a gear train 24 to rear wheels 20. Toy vehicle 12 may also support a plurality of batteries 26 for powering motor 22.

Remote control 40 includes a remote control housing 42 which is a pistol-shaped and hand-holdable by a hand 44 of a user. Remote control 40 includes a pivotable trigger switch 46 shown operated by the index finger 48 of hand 44 and a plurality of buttons generally shown at 50 which are actuatable by thumb 52 of hand 44. As described below in detail, buttons 50 control a sound producing system housed within remote control 40 to selectively produce sound which emanates through speaker openings 54 in remote control 40.

It is specifically noted here that the reference to remote control includes both a wired remote control like that depicted in FIG. 1 wherein remote control 40 is coupled by a hard wire 30 to toy vehicle 12, as well as a remote control system which uses radio control signals to remotely control toy vehicle 12. The latter type of remote control system is also known as a radio control system. It is also noted that the present invention is not limited to the type or configuration of toy vehicle 12 depicted in FIG. 1 since any toy vehicle configuration which can be controlled by a remote control is applicable to the present invention.

Reference is now made to FIGS. 2-5 which depict the construction of remote control 40 in detail. Housing 42 of remote control 40 is preferably formed from a thermoplastic material and includes first and second opposing housing sections 42*a* and 42*b* which are appropriately coupled together by a snap-fit, screws and the like. A handle section 43*a* which may also include opposing sections is appropriately coupled to lower case section 42*b* of housing 42 as depicted. Trigger switch 46 is pivotably coupled to handle section 43 through post 60 as depicted and is adapted to actuate a switch 62. Wire 30 is coupled to switch 62 such that appropriate electrical contacts 64, 66 and 68 are selectively coupled upon the upward or downward pivoting of trigger switch 46 as shown in phantom in FIG. 2. In the rest position of trigger switch 46, motor 22 of toy vehicle 12 will not be actuated. However, for example, when trigger switch 46 is pivoted upwardly, motor 22 will drive toy vehicle 12 in a first direction, and when pivoted downwardly, motor 22 of toy vehicle 12 will drive toy vehicle 12 in a opposite direction.

A speaker 70 is supported on upper housing section 42*a* about speaker opening 54 thereof so that sound produced by speaker 70 emanates through speaker opening 54. Speaker 70 is electrically coupled to a circuit board 80 which supports the relevant sound producing circuit components. A battery case 74 is supported on lower case section 42*b* of housing 42 and supports four button batteries 76*a* through 76*d*. Batteries 76*a*–76*d* are also electrically coupled to circuit board 80 to power same. It is noted that other battery configurations and housing constructions may be utilized.

Switch buttons 90*a* through 90*d* actuate switches 92*a* through 92*d*, respectively, supported on circuit board 80 and extend for manual pressing through openings 94*a* through 94*d*, respectively in upper housing section 42*a* of housing 42.

Figure 6:
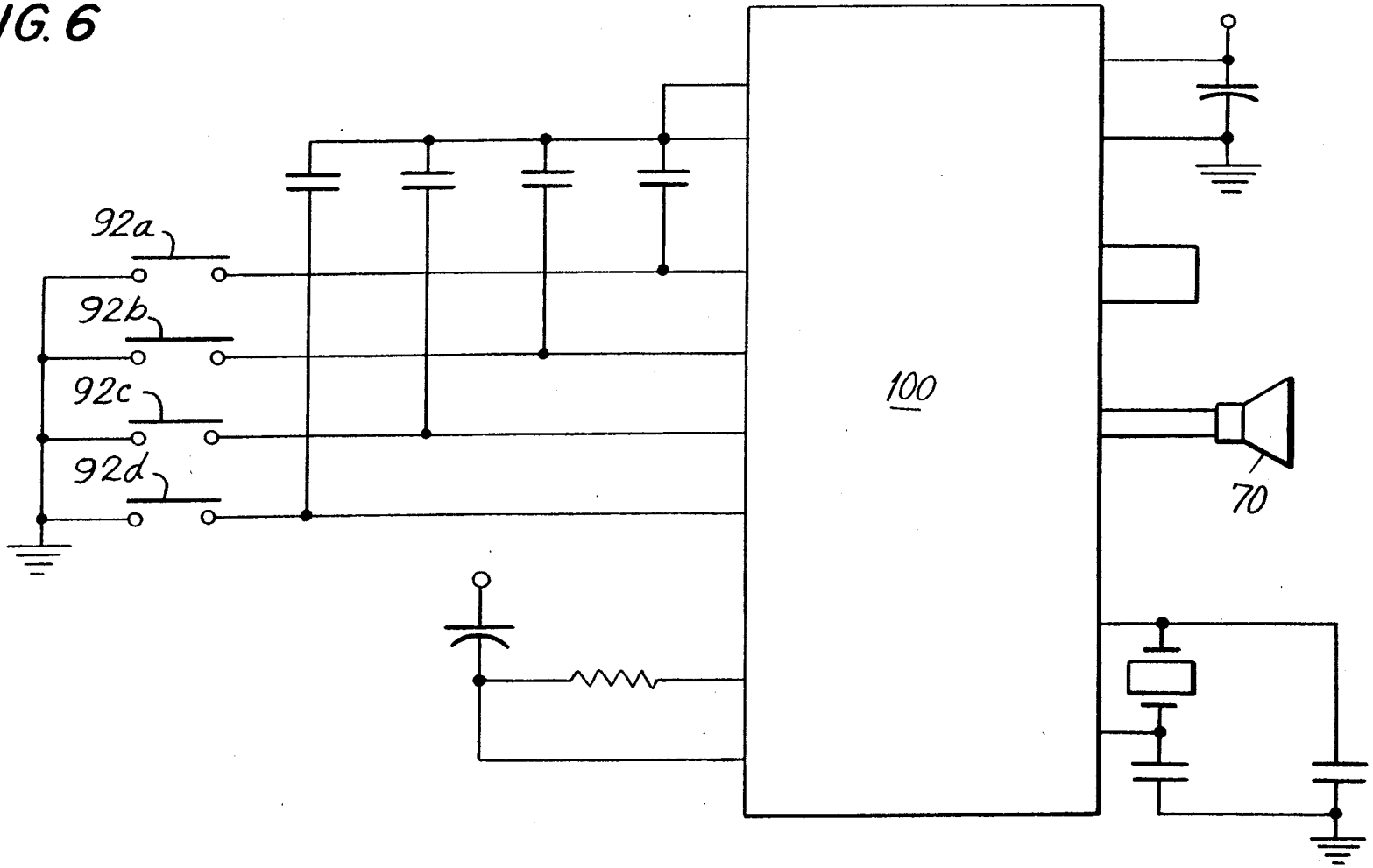
FIG. 6 is a schematic circuit diagram of one embodiment of the sound producing circuit used in the remote control of the present invention.
Figure 7:
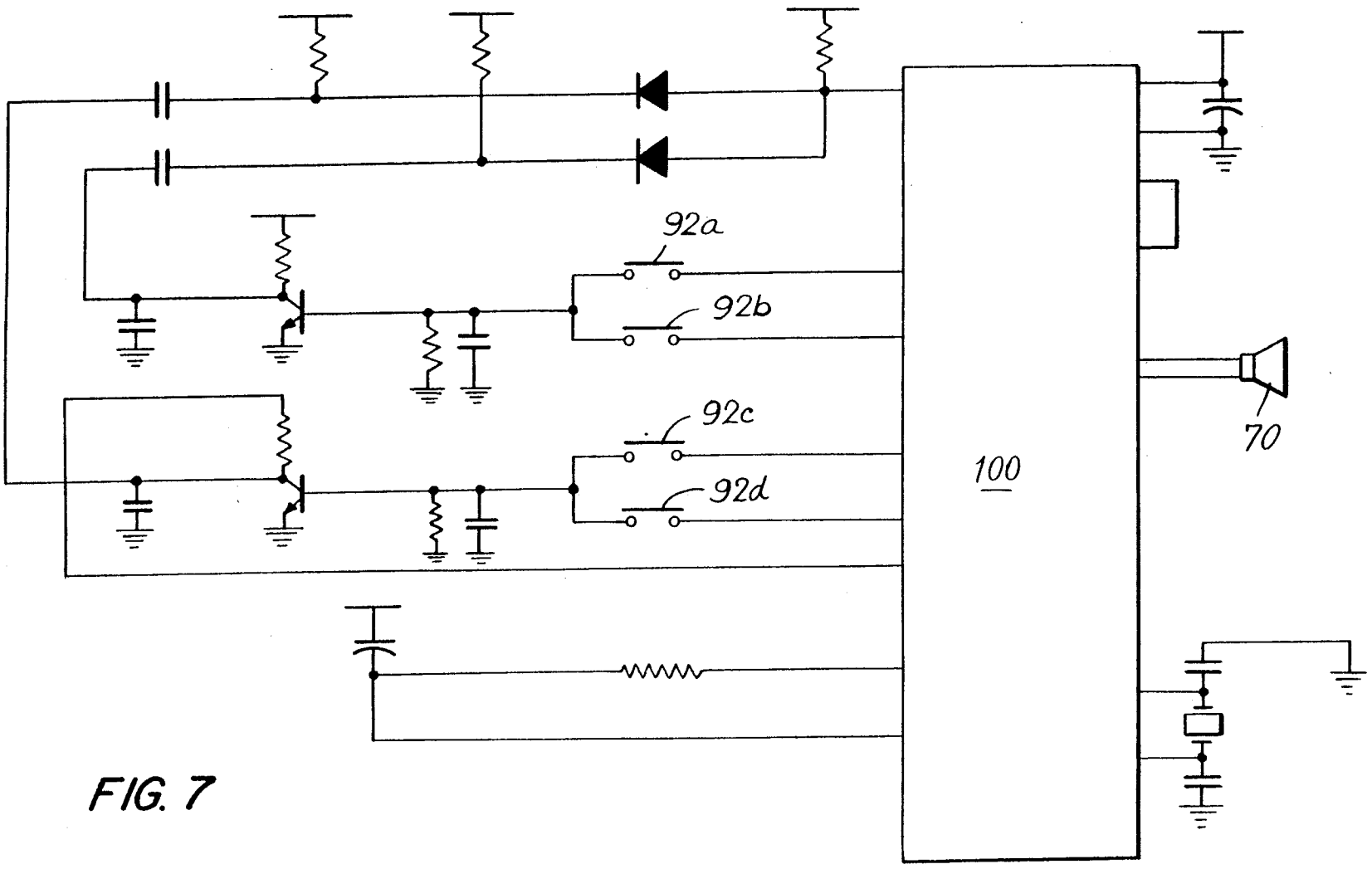
FIG. 7 is a schematic circuit diagram of an alternative sound producing circuit for use in the remote control of the present invention.

A first schematic construction of circuit board 80 appears in FIG. 6. A second construction for circuit board 80 appears in FIG. 7 of the drawings. Such sound producing circuits are of a well-known construction and include a single LSI electronic chip 100. Sounds are pre-recorded, digitized and stored on chip 100. Such chips and circuitry for controlling same are disclosed in U.S. Pat. Nos. 4,214,125; 4,384,169; 4,384,170; 4,433,434 and 4,548,110, the disclosures of which are incorporated herein by reference as though fully set forth. Such LSI electronic sound producing chips are available and may be purchased from a company known as Electronic Speech Systems (ESS) of California, owner of the patents referenced above. The chip used in the present invention is the ES3016 chip.

Figure 4:
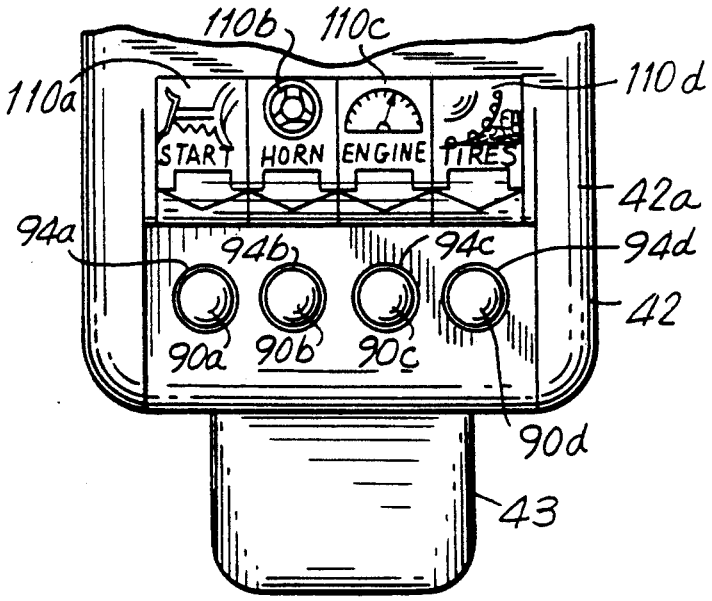
FIG. 4 is a partial top plan view taken along line 4—4 of FIG. 2.
Figure 5:
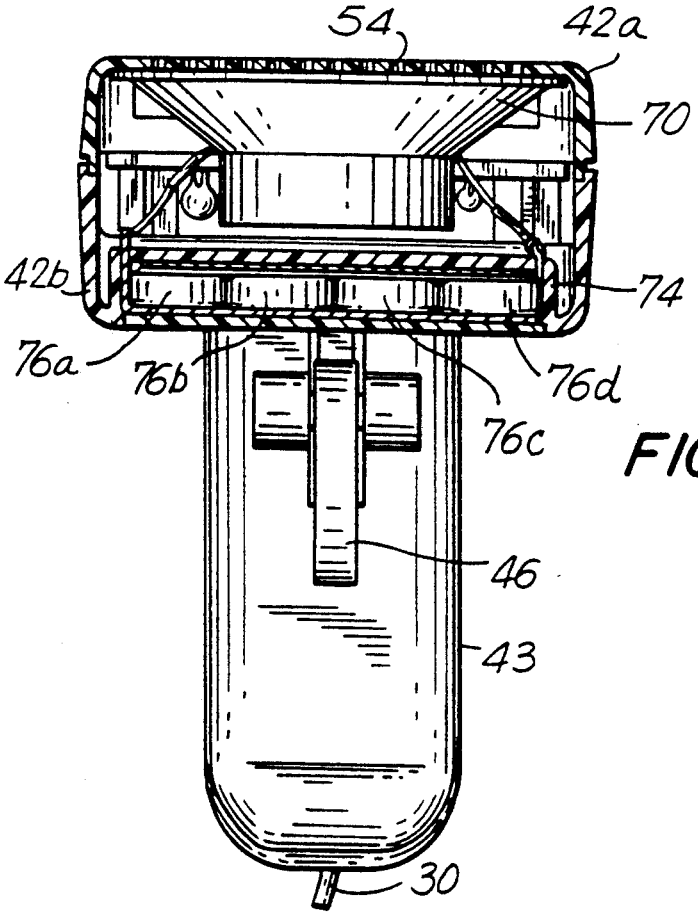
FIG. 5 is a sectional view taken along line 5—5 of FIG. 2.

In the present embodiment, the sounds pre-recorded on a chip 100 are sounds related to vehicles or other action, such as running engine, a horn, screeching tires, a revving engine or the like. Buttons 90*a*–90*d* control the sounds produced by circuit 80. Labels 110*a*–110*d* may be provided adjacent buttons 90*a*–90*d*, respectively, to indicate to a user the sounds that will be produced by pressing an associated button. Hence, as best depicted in FIG. 4, when button 90*a* is depressed and released, the sound of a starting car will be produced by circuit 80 and the sound therefrom will emanate from speaker 70. The running engine noise may continue after release of the button. When button 90*b* is depressed, a car horn will be heard. When button 90*c* is depressed, a revving engine will be heard. In addition, a voiceover on the chip may be recorded so that words such as "Rev It Up" are also heard when button 90*c* is depressed. Likewise when button 90*d* is depressed, the sound of screeching tires will be heard. A voiceover on the chip may recite "Burn It" or the like in conjunction with the pressing of button 90*d*.

All of the sounds generated by the pressing of buttons 90*a*–90*d* are generated by circuit board 80 and are produced through speaker 70 supported within housing 42 of remote control 40. Hence, while trigger 46 of remote control 40 can be used to operate toy vehicle 12, buttons 90*a*–90*d* can be selectively depressed by the thumb 52 of a user to generate various sounds. This activity substantially increases the play value in a remote control toy vehicle system and, because of the clear and distinctive sounds produced by chip 100, the sounds are realistic.

It is noted that the volume of sound produced by circuit 80 through speaker 70 ma be set through an amplifier circuit contained on circuit board 80. In addition, a timing circuit or circuits may be provided for selectively turning off the sounds after the elapse of a predetermined time interval.

Accordingly, the present invention provides a remotely controlled toy vehicle with enhanced play value since sounds are produced in the remote control and emanate directly therefrom. The sounds are preferably related to vehicles so that real play action may be simulated.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A remote control toy vehicle system comprising a toy vehicle including motor means for selectively driving said toy vehicle, a remote control electrically coupled to said toy vehicle but remote therefrom including manually actuatable first control means for controlling said motor means, said remote control further including sound producing means for selectively producing sounds related to said toy vehicle and manually actuatable second control means for controlling the sounds producible by said sound producing means.

2. The remote control toy vehicle system as claimed in claim 1, wherein said remote control is electrically coupled to said toy vehicle through a wire.

3. The remote control toy vehicle system as claimed in claim 1, wherein said remote control is electrically coupled to said toy vehicle through radio control signals.

4. The remote control toy vehicle system as claimed in claim 1, wherein said remote control is hand-holdable and pistol-shaped.

5. The remote control toy vehicle system as claimed in claim 4, wherein said first control means is a trigger switch actuatable by a first finger of a user.

6. The remote control toy vehicle system as claimed in claim 5, wherein said second control means includes a plurality of push buttons coupled to said sound producing means actuatable by a second finger of a user.

7. The remote control toy vehicle system as claimed in claim 1, wherein said sound producing means includes a sound producing circuit having an LSI electronic sound chip and speaker means supported on said remote control and coupled to said sound producing circuit for producing sounds generated by said sound producing circuit.

8. The remote control toy vehicle system as claimed in claim 7, wherein said sound producing circuit includes a plurality of switches for controlling the sounds produced thereby, said second control means including a plurality of push buttons coupled respectively to said plurality of switches.

9. The remote control toy vehicle system as claimed in claim 8, wherein said sound producing circuit includes an LSI electronic sound chip having prerecorded vehicle-related sounds thereon.

10. The remote control toy vehicle system as claimed in claim 9, wherein said electronic chip includes both pre-recorded sounds and words.

11. The remote control toy vehicle system as claimed in claim 1, wherein said second control means includes four switches operatively coupled to said sound producing means, each said switch controlling a different sound produced by said sound producing means.

12. A remote control for a toy vehicle, said toy vehicle including motor means for selectively powering said toy vehicle comprising a housing remote from said toy vehicle, first control means supported by said housing for remotely controlling said motor means, sound producing means supported by said housing for selectively producing action-related sounds, and second control means supported by said housing and coupled to said sound producing means for controlling the sounds produced by said sound producing means.

13. The remote control as claimed in claim 12, wherein said housing is pistol-shaped.

14. The remote control as claimed in claim 13, wherein said first control means is a trigger switch pivotally supported on said housing.

15. The remote control as claimed in claim 12, wherein said sound producing means includes an electronic sound chip having prerecorded sounds thereon.

16. The remote control as claimed in claim 15, wherein said second control means includes a plurality of switches for controlling the sounds produced by said sound chip.

17. The remote control as claimed in claim 16, wherein said sound producing means includes a speaker supported on said housing.

18. A remote control for a toy vehicle comprising a housing, first switch means supported on said housing for controlling said toy vehicle, a sound producing circuit supported on said housing for selectively producing action-related sounds, and second switch means supported on said housing and coupled to said sound producing circuit for controlling the sounds producible by said sound producing circuit.

19. The remote control as claimed in claim 18, wherein said housing is hand-holdable.

20. The remote control as claimed in claim 18, wherein said sound producing circuit includes an electronic sound chip.

* * * * *